US009465339B2

(12) United States Patent
Lee et al.

(10) Patent No.: US 9,465,339 B2
(45) Date of Patent: Oct. 11, 2016

(54) FIXING DEVICE AND IMAGE FORMING APPARATUS HAVING THE SAME

(71) Applicant: Samsung Electronics Co., Ltd., Suwon-si, Gyeonggi-do (KR)

(72) Inventors: Seung-jun Lee, Suwon-si (KR); Dong-jin Seol, Suwon-si (KR); Bong-hee Lee, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/570,096

(22) Filed: Dec. 15, 2014

(65) Prior Publication Data

US 2015/0198919 A1 Jul. 16, 2015

(30) Foreign Application Priority Data

Jan. 10, 2014 (KR) ..... 10-2014-0003609

(51) Int. Cl.
*G03G 15/20* (2006.01)

(52) U.S. Cl.
CPC ..... *G03G 15/2075* (2013.01)

(58) Field of Classification Search
CPC ..... G03G 15/2028; G03G 15/2075
See application file for complete search history.

(56) References Cited

U.S. PATENT DOCUMENTS

2009/0035034 A1* 2/2009 Nagase ..... G03G 15/2025 399/329
2009/0252542 A1* 10/2009 Creteau ..... G03G 15/2025 399/329

FOREIGN PATENT DOCUMENTS

JP 2004361580 A * 12/2004
JP 2010282237 A * 12/2010
JP 2012-220553 11/2012

* cited by examiner

*Primary Examiner* — Erika J Villaluna
(74) *Attorney, Agent, or Firm* — Staas & Halsey LLP

(57) ABSTRACT

A fixing device including a lubricant supply unit is provided. The lubricant supply unit supplies a lubricant between a fixing belt and a nip forming member and includes a lubricant storage member and an impregnation member. The lubricant storage member stores the lubricant, and the impregnation member impregnates the lubricant discharged from the lubricant storage member and supplies the lubricant to an inner surface of the fixing belt. The lubricant stored in the lubricant storage member includes base oil and a thickener, and a weight of the thickener is equal to or less than 20% with respect to a weight of the lubricant.

21 Claims, 9 Drawing Sheets

FIXING DEVICE AND IMAGE FORMING APPARATUS HAVING THE SAME

CROSS-REFERENCE TO RELATED APPLICATIONS

This application is related to, and claims the priority benefit of Korean Patent Application No. 10-2014-0003609, filed on Jan. 10, 2014, in the Korean Intellectual Property Office, the disclosure of which is incorporated herein in its entirety by reference.

BACKGROUND

1. Field

One or more embodiments relate to a fixing device that reduces abrasion between a fixing belt and a nip forming member, and an image forming apparatus including the fixing device.

2. Description of the Related Art

Electro-photographic image forming apparatuses supply a toner to a latent image formed in a photoconductor to form a visible toner image, transfer the toner image to a recording medium, and fixes the transferred toner image to the recording medium to print an image on the recording medium.

To fix the toner image transferred to the recording medium in a process of printing the image on the recording medium, the image forming apparatus may include a fixing device that heats and presses the recording medium to which the toner image is transferred.

The fixing device may include a pressure roller that presses the recording medium and a fixing belt that rotates when the fixing belt contacts an outer surface of the pressure roller and that heats the recording medium. A pressure roller and a nip forming member that forms a fixing nip on a contact portion of the fixing belt are disposed in an inner surface of the fixing belt.

Such a fixing device has a structure in which the fixing belt rotates with respect to the nip forming member, and thus, friction occurs in a portion where the fixing belt comes into contact with the nip forming member. A difference in speed may occur between the fixing belt and the pressure roller due to the friction, and torque of equal to or greater magnitude than a predetermined magnitude may be applied to the pressure roller. Thus, a slip phenomenon which an unfixed toner image slips on the recording medium may occur. Abrasion may occur in the nip forming member or the fixing belt due to the friction. In a case where such abrasion becomes severe, the fixing belt may be damaged. In order to prevent the slip phenomenon and damage to the fixing belt, a lubricant may be coated on a region between the fixing belt and the nip forming member to reduce friction therebetween.

The lubricant may stay between the fixing belt and the nip forming member for a long time in order to be stably fixed. However, the lubricant coated on the region between the nip forming member and the fixing belt may move in association with the rotation of the fixing belt to thereby leak to the outside, which may lead to slip and damage even when a large amount of lubricant is coated on the region between the nip forming member and the fixing belt at a time.

SUMMARY

One or more embodiments include a fixing device having a long lifespan through a structure in which a lubricant is continuously supplied between a nip forming member and a fixing belt, and an image forming apparatus including the fixing device.

Additional aspects will be set forth in part in the description which follows and, in part, will be apparent from the description, or may be learned by practice of the presented embodiments.

According to one or more embodiments, a fixing device includes a rotation unit that is rotatable, a fixing belt that contacts an outer surface of the rotation unit and is rotated by rotating of the rotation unit, a nip forming member that contacts an inner surface of the fixing belt and forms a fixing nip in a contact portion between the rotation unit and the fixing belt, and a lubricant supply unit that supplies a lubricant between the fixing belt and the nip forming member and comprises a lubricant storage member storing the lubricant and an impregnation member impregnating the lubricant discharged from the lubricant storage member and supplying the lubricant to the inner surface of the fixing belt. The lubricant stored in the lubricant storage member comprises base oil and a thickener, and a weight of the thickener is equal to, or less than 20% with respect to a weight of the lubricant.

The base oil may include a heat-resisting fluorine resin. The heat-resisting fluorine resin may include perfluoropolyether (PFPE).

The thickener may include a heat-resisting fluorine resin. The heat-resisting fluorine resin may include polytetrafluoroethylene (PTFE).

A viscosity index of the base oil may be approximately 50 to 800. The lubricant supply unit may be disposed on an upstream side or a downstream side of the nip forming member in a rotation direction of the fixing belt.

The impregnation member may include at least one of felt and fabric. The impregnation member may have a weight per unit area of 50 to 600 g/m$^2$ based on a thickness of 1 mm.

A contact portion with the inner surface of the fixing belt in the nip forming member may include at least one of felt and fabric.

The contact portion of the nip forming member may have a greater abrasion resistance than the impregnation member.

The lubricant storage member may be continuously formed in a longitudinal direction of the fixing belt. Alternatively, the lubricant storage member may be intermittently formed in a longitudinal direction of the fixing belt.

The fixing device may further include an external supply unit that is disposed outside of the fixing belt and supplies a lubricant to the lubricant storage member.

The fixing device may further include a heat source that heats the fixing belt.

The rotation unit may be a pressure roller that presses a recording medium passing through the fixing nip.

According to one or more embodiments, an image forming apparatus includes a photoconductor in which a latent image is formed, a developing unit that supplies a toner to the latent image and forms a visible toner image in a recording medium, and the fixing device that applies heat and pressure to the toner image transferred to the recording medium and fixes the toner image and that includes a rotation unit that is rotatable, a fixing belt that contacts an outer surface of the rotation unit and is rotated by rotating of the rotation unit, a nip forming member that contacts an inner surface of the fixing belt and forms a fixing nip in a contact portion between the rotation unit and the fixing belt, and a lubricant supply unit that supplies a lubricant between the fixing belt and the nip forming member and comprises a lubricant storage member storing the lubricant and an impregnation member impregnating the lubricant discharged from the lubricant storage member and supplying the lubricant to the inner surface of the fixing belt.

BRIEF DESCRIPTION OF THE DRAWINGS

These and/or other aspects will become apparent and more readily appreciated from the description of the embodiments, taken in conjunction with the accompanying drawings in which.

DETAILED DESCRIPTION

Figure 1:
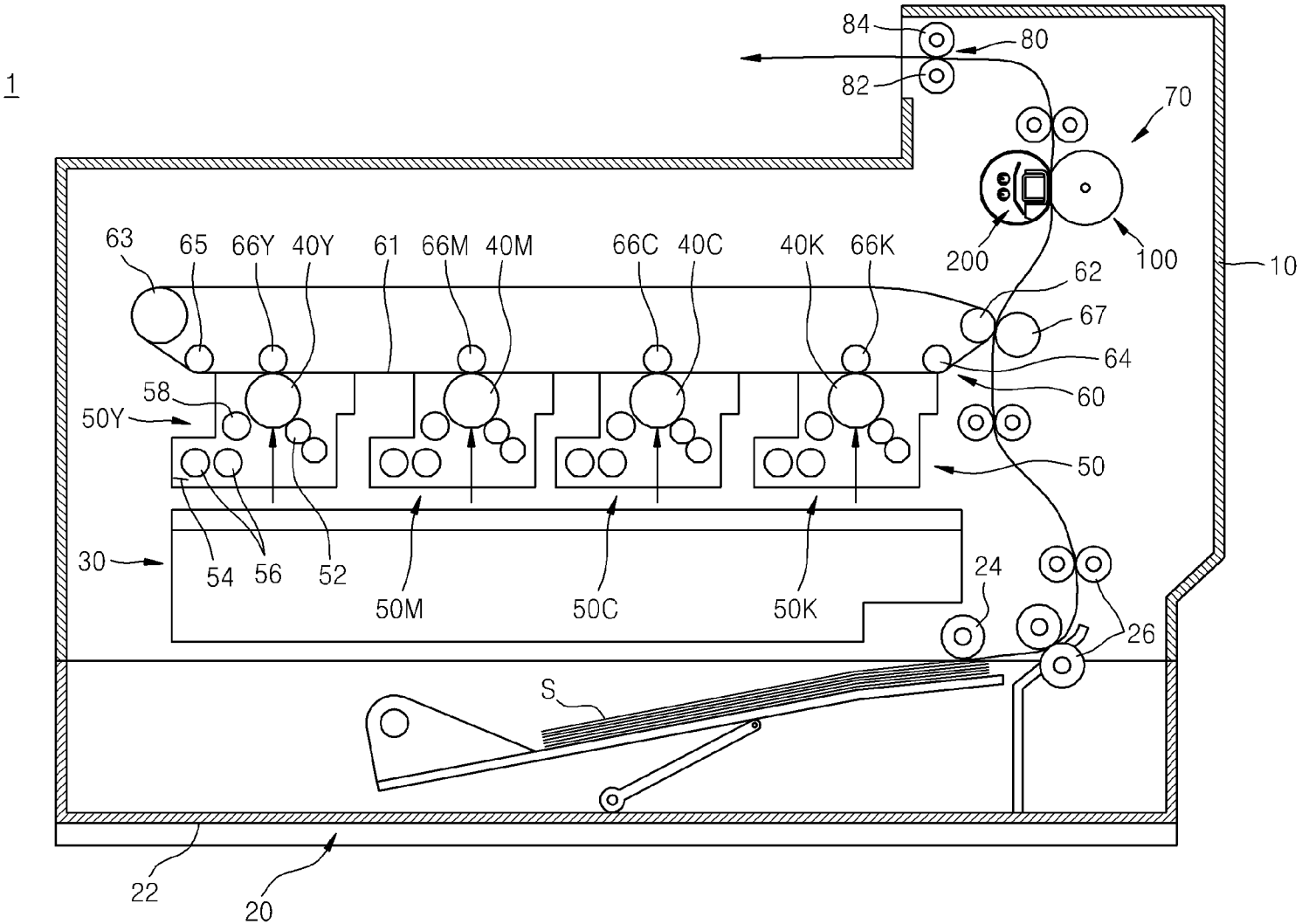
FIG. 1 illustrates a configuration of an image forming apparatus according to an embodiment.

Exemplary embodiments are described in detail with reference to the attached drawings. Like reference numerals in the drawings denote like elements, and thus their description will be omitted. Expressions such as "at least one of," when preceding a list of elements, modify the entire list of elements and do not modify the individual elements of the list.

FIG. 1 is a diagram illustrating a configuration of an image forming apparatus 1 according to an embodiment.

As illustrated in FIG. 1, the image forming apparatus 1 includes a main body 10, a recording medium supply unit 20, a optical scanning unit 30, a plurality of photoconductors 40Y, 40M, 40C, and 40K, a developing unit 50, a transfer unit 60, a fixing device 70, and a recording medium discharge unit 80.

The main body 10 forms a contour of the image forming apparatus 1 and supports various parts provided therein. A portion of the main body 10 may be configured to be opened or closed. A user may replace or repair various parts through the opened portion of the main body 10 and may remove a recording medium S mounted within the main body 10.

The recording medium supply unit 20 supplies the recording medium S toward the transfer unit 60. The recording medium supply unit 20 includes a cassette 22 accommodating the recording medium S, a pickup roller 24 that picks up one recording medium S at a time which is accommodated in the cassette 22, and transport rollers 26 that transport the picked-up recording medium S toward the transfer unit 60.

The optical scanning unit 30 irradiates the photoconductors 40Y, 40M, 40C, and 40K with light corresponding to image information to form a latent image on surfaces of the photoconductors 40Y, 40M, 40C, and 40K. Although not illustrated in FIG. 1, the optical scanning unit 30 may include a light source that emits a light beam, a deflector that deflects a light beam emitted through a polygon mirror rotated by a motor, and an f-theta lens that condenses the deflected light beam on the photoconductors.

The developing unit 50 supplies a toner, which is a developer, to the latent image formed in the photoconductors 40Y, 40M, 40C, and 40K to form a visible toner image. The developing unit 50 may include four developing devices 50Y, 50M, 50C, and 50K accommodating developers of different colors, for example, developers of black (K), cyan (C), magenta (M), and yellow (Y) colors, respectively.

Each of the developing devices 50Y, 50M, 50C, and 50K includes a charger 52, a developer storage unit 54, a developer transport member 56, and a developing member 58. The charger 52 charges the surfaces of the photoconductors 40Y, 40M, 40C, and 40K prior to forming the latent image on the photoconductors 40Y, 40M, 40C, and 40K. The developer stored in the developer storage unit 54 is transported toward the developing member 58 by the developer transport member 56, and the developing member 58 supplies the developer to the latent images formed on the photoconductors 40Y, 40M, 40C, and 40K to form a visible image.

Although FIG. 1 illustrates an example in which four photoconductors 40Y, 40M, 40C, and 40K are included in the developing devices 50Y, 50M, 50C, and 50K, respectively, a configuration may be made such that four developing devices form a visible image on one photoconductor.

The transfer unit 60 receives the visible image formed in the photoconductors 40Y, 40M, 40C, and 40K and transfers the image to the recording medium S. The transfer unit 60 includes a transfer belt 61, a driving roller 62, a supporting roller 63, tension rollers 64 and 65, and transfer rollers 66Y, 66M, 66C, and 66K.

The transfer belt 61 may be rotatably supported by the driving roller 62 and the supporting roller 63. The driving roller 62 rotates by receiving electric power from a driving source (not illustrated) mounted within the main body 10. The supporting roller 63 may be disposed on an opposite side to the driving roller 62 so as to support an internal surface of the transfer belt 61.

An outer circumferential surface of the transfer belt 61 faces the photoconductors 40Y, 40M, 40C, and 40K. The transfer rollers 66Y, 66M, 66C, and 66K may be disposed so as to correspond to the photoconductors 40Y, 40M, 40C, and 40K, respectively, and support an inner circumferential surface of the transfer belt 61.

When the image forming apparatus 1 performs a color printing operation, the transfer rollers 66Y, 66M, 66C, and 66K are pressed toward the photoconductors 40Y, 40M, 40C, and 40K, respectively. The visible images formed on the photoconductors 40Y, 40M, 40C, and 40K, respectively, are transferred to the transfer belt 61 by the transfer rollers 66Y, 66M, 66C, and 66K and overlap each other, and the image of the transfer belt 61 is supplied from the recording medium supply unit 20 and is transferred to the recording medium S passing between a transfer roller 67 and the transfer belt 61.

When the image forming apparatus 1 performs a monochrome printing operation, the transfer roller 66K corresponding to the photoconductor 40K may be pressed toward the photoconductor 40K corresponding to the transfer roller 66K, and the other transfer rollers 66Y, 66M, and 66C are separated from their corresponding photoconductors 40Y, 40M, and 40C, respectively.

The recording medium S passing through the transfer unit 60 enters the fixing device 70. The fixing device 70 is configured to apply heat and pressure to the recording medium S and fixes an unfixed toner image on the recording medium S to the recording medium S.

The recording medium S passing through the fixing device 70 is guided to the recording medium discharge unit 80, and the recording medium discharge unit 80 discharges the recording medium S to the outside of the image forming apparatus 1. The recording medium discharge unit 80 includes a discharge roller 82 and a discharge backup roller 84 that is installed to face the discharge roller 82.

Figure 2:
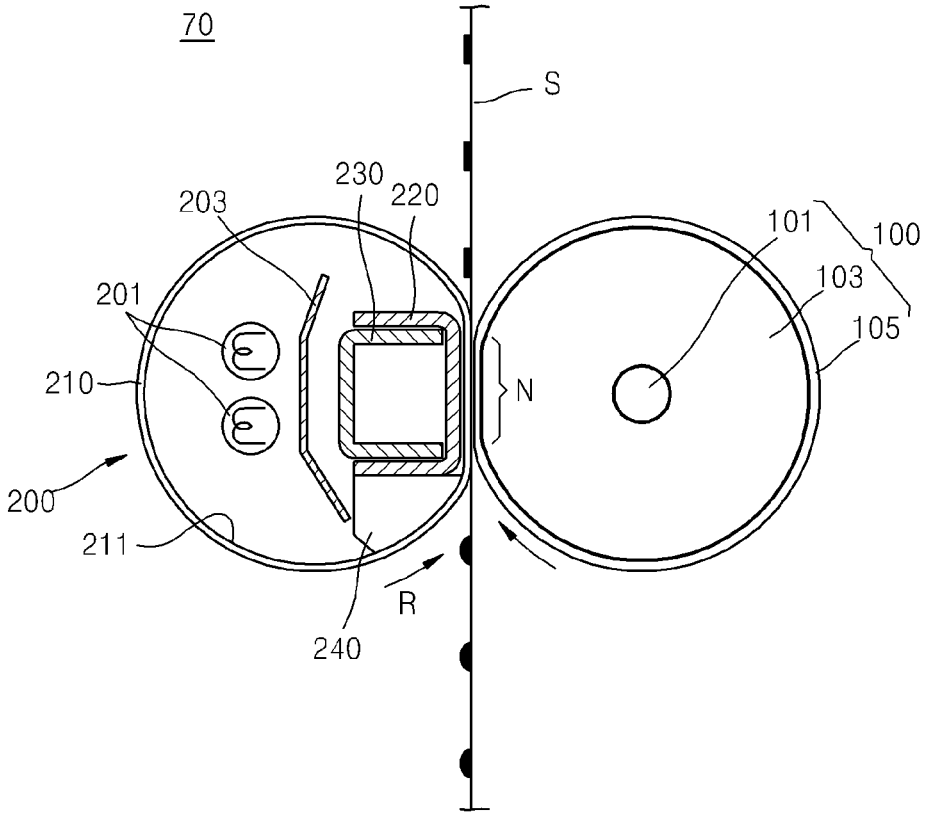
FIG. 2 is a schematic cross-sectional view of an exemplary fixing device.

FIG. 2 illustrates an exemplary cross-sectional view of an example of the fixing device 70 illustrated in FIG. 1. Referring to FIG. 2, the fixing device 70 includes a pressure unit 100 and a heating unit 200 that are disposed to face each other and form a fixing nip N through which the recording medium S passes.

The pressure unit 100, which is an example of a rotation unit which is rotatable, presses the recording medium S passing through the fixing nip N. The pressure unit 100 rotates by receiving electric power from a driving source (not illustrated) that is mounted in the main body 10 of the image forming apparatus 1. In a process in which the recording medium S passes through the fixing nip N between the pressure unit 100 and a fixing belt 210, a toner image transferred to the recording medium S is fixed to the recording medium S by heat and pressure.

The pressure unit 100 may be a pressure roller. The pressure unit 100 includes a shaft 101 and an elastic layer 103. The shaft 101 is disposed in a central portion of the pressure unit 100 and functions as a rotation axis. The shaft 101 may be formed of a metal material such as aluminum or stainless steel. The elastic layer 103 may be disposed so as to cover the circumference of the shaft 101 and forms the fixing nip N with the fixing belt 210 while being elastically deformed by pressure between the pressure unit 100 and the fixing belt 210. The elastic layer 103 may be a heat-resisting elastomer layer. A heat-resisting elastomer may be, for example, silicon elastomer or fluorine elastomer. A surface of the elastic layer 103 may be provided with a release layer 105 that prevents the recording medium S from being attached to the pressure unit 100. For example, the release layer 105 may be formed of one of perfluoroalkoxy (PFA), polytetrafluoroethylene (PTFE), and fluorinated ethylene propylene (FEP), a blend including two or more of the materials stated above, or a copolymer thereof.

The heating unit 200, which provides heat to the recording medium S, may include a heat source 201, the fixing belt 210, and a nip forming member 220 that is disposed inside the fixing belt 210.

The heat source 201, which heats the fixing belt 210, may be disposed inside the fixing belt 210. The heat source 201 may be separate from the fixing belt 210 and may heat the fixing belt 210 by radiation heating. For example, a halogen lamp or a induction heating coil may be used as the heat source 201. However, the position and type of the heat source 201 are not limited thereto. For example, the heat source 201 may be disposed outside of the fixing belt 210. The heat source 201 may be disposed so as to come into contact with the fixing belt 210 to heat the fixing belt 210. The heat source 201 may be formed separately from the fixing belt 210, or may be a heat-generating layer included in the fixing belt 210.

The fixing belt 210 contacts an outer surface of the pressure unit 100 and is rotated by rotating of the pressure unit 100. The fixing belt 210 may have an endless shape. However, the fixing belt 210 is not limited to that structure and may have a film shape with an end and may be configured to be wound by a pair of rollers.

The fixing belt 210 is heated by the heat source 201. The heated fixing belt 210 comes into contact with the recording medium S passing through the fixing nip N to heat the recording medium S, thereby fixing the toner image, transferred to the recording medium S, to the recording medium S.

Although the fixing belt 210 is not illustrated in the drawing, the fixing belt 210 may include a base layer, an elastic layer, and a release layer. The base layer may include at least one of a plastic material such as a heat-resisting resin and a metal material.

The heat-resisting resin may be polyimide, polyamide-imide, polyether ether ketone, or the like, and the metal material may be nickel (Ni), stainless steel, copper (Cu), or an alloy thereof. The elastic layer may be a heat-resisting elastomer layer. The heat-resisting elastomer may be, for example, silicon elastomer or fluorine elastomer. For example, the release layer may be formed of one of PFA, PTFE, and FEP, a blend including two or more of the materials stated above, or a copolymer thereof.

The fixing belt 210 may have a thickness of approximately 30 μm to 500 μm. Thus, a high temperature rising performance of the fixing belt 210 can be secured.

The nip forming member 220 contacts an inner surface 211 of the fixing belt 210 and supports the fixing belt 210 that is pressed by the pressure unit 100. Thus, the fixing nip N is formed between the pressure unit 100 and the fixing belt 210. The nip forming member 220 is coupled to a supporting member 230 to be fixed and supported by the supporting member 230. A heat transfer rate of the nip forming member 220 may be smaller than a heat transfer rate of the supporting member 230. Thus, heat transferred to the nip forming member 220 may be prevented from being lost by the supporting member 230.

The nip forming member 220 may be disposed to face the pressure unit 100 that presses an outer circumferential surface of the fixing belt 210. Thus, the nip forming member 220 presses the inner surface 211 of the fixing belt 210.

Since the nip forming member 220 may be fixed by the supporting member 230, a friction force acts on a contact region between the fixing belt 210 and the nip forming member 220 when the fixing belt 210 is rotated. The friction force may increase torque acting on the pressure unit 100 or may cause the recording medium S and the fixing belt 210 to slip in the fixing nip N. In order to prevent such a phenomenon, a lubricant may be supplied to a region 215 (see, for example, FIG. 4) between the fixing belt 210 and the nip forming member 220 so as to prevent a direct contact between the fixing belt 210 and the nip forming member 220.

However, the lubricant supplied to the region 215 between the fixing belt 210 and the nip forming member 220 may tend to easily discharge or dissipate. For example, the lubricant may discharge from the region 215 between the fixing belt 210 and the nip forming member 220 during the rotation of the fixing belt 210 due to the fluidity of the lubricant. Since the region 215 between the fixing belt 210 and the nip forming member 220 may be at a high temperature and high pressure state due to the heat source 201 and the pressure unit 100, the lubricant supplied to the region 215 between the fixing belt 210 and the nip forming member 220 may evaporate under the high temperature and pressure environment.

An exemplary technical advantage of an embodiment is providing the fixing device 70 in which the lubricant may be supplied to the region 215 between the fixing belt 210 and the nip forming member 220 for a long time even if the lubricant supplied to the region 215 between the fixing belt 210 and the nip forming member 220 discharges or dissipates. The fixing device 70 according to an embodiment includes a lubricant supply unit 240 having a predetermined structure and a predetermined lubricant G1 used for the lubricant supply unit 240. An exemplary lubricant supply unit 240 and the lubricant G1 are described in detail.

[Lubricant Supply Unit]

The lubricant supply unit 240 may be disposed inside the fixing belt 210 and supplies a lubricant to the region 215 between the fixing belt 210 and the nip forming member 220. For example, the lubricant supply unit 240 may supply a lubricant to the inner surface 211 of the fixing belt 210. The lubricant supplied to the inner surface 211 of the fixing belt 210 may move to the region 215 between the nip forming member 220 and the fixing belt 210 by the rotation of the fixing belt 210. A heat shield member 203 may be disposed between the heat source 201 and the lubricant supply unit 240. A lubricant G3 supplied to the inner surface 211 of the fixing belt 210 may be prevented from evaporating by the heat source 201 by the heat shield member 203 while the lubricant G3 moves in association with the rotation of the fixing belt 210.

The lubricant supply unit 240 may be disposed on an upstream side of the nip forming member 220 in a rotation direction R of the fixing belt 210. A lubricant may be supplied on the upstream side of the nip forming member 220 so that the exposure of the lubricant to the heat source 201 may be minimized and the lubricant may be stably supplied to the region 215 between the nip forming member 220 and the fixing belt 210.

Figure 3A:
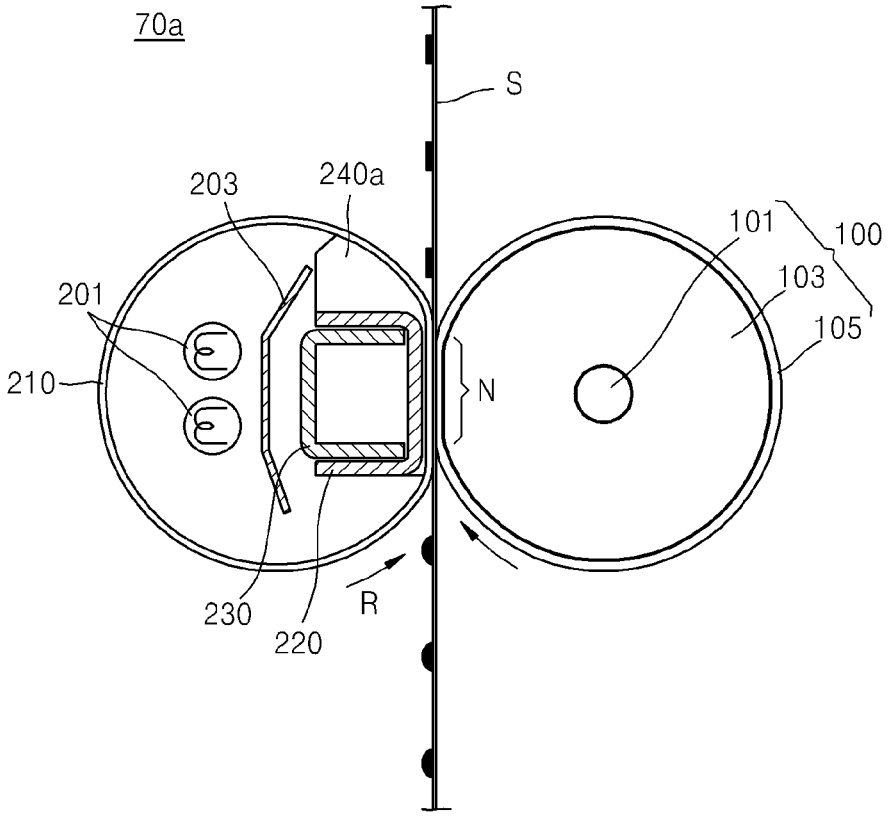
FIGS. 3A and 3B illustrate exemplary cross-sectional views of a fixing device.
Figure 3B:
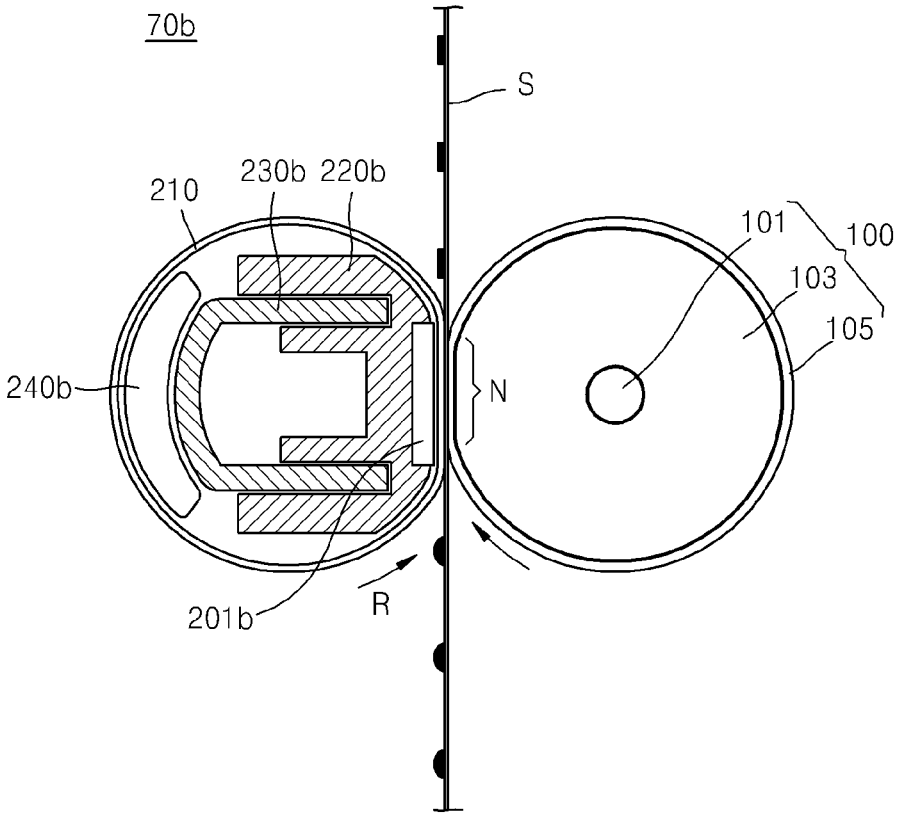

However, the position of the lubricant supply unit 240 is not limited to the upstream side of the nip forming member 220 and may vary appropriately as necessary. For example, as illustrated in FIG. 3A, a lubricant supply unit 240*a* may be disposed on a downstream side of the nip forming member 220 in the rotation direction R of the fixing belt 210. Alternatively, as illustrated in FIG. 3B, a lubricant supply unit 240*b* may be disposed separate from the contact region between the nip forming member 220 and the fixing belt 210. In a fixing device 70*b* illustrated in FIG. 3B, a heat source 201*b* may be disposed so as to face the fixing nip N. Thus, it is possible to minimize the evaporation of a lubricant, supplied by the lubricant supply unit 240*b*, by the heat source 201*b* during the movement of the lubricant along the fixing belt 210. The shapes of a nip forming member 220*b* and a supporting member 230*b* may vary in order to dispose the heat source 201*b*.

Figure 4:
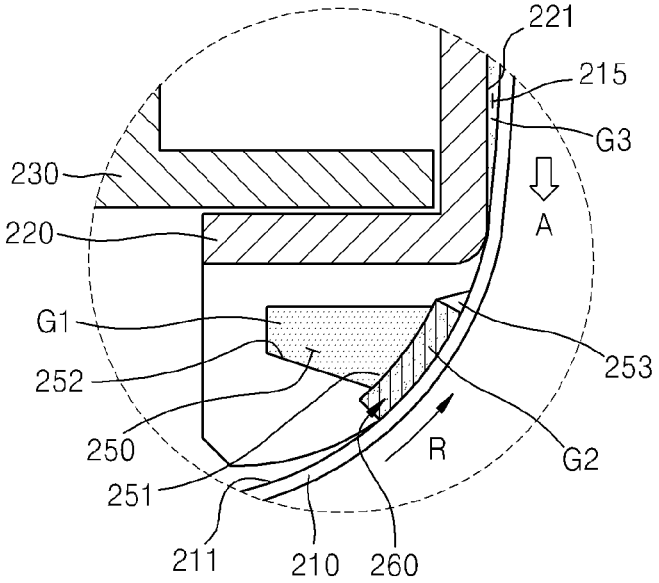
FIG. 4 is an enlarged exemplary view of a lubricant supply unit of FIG. 2.
Figure 5:
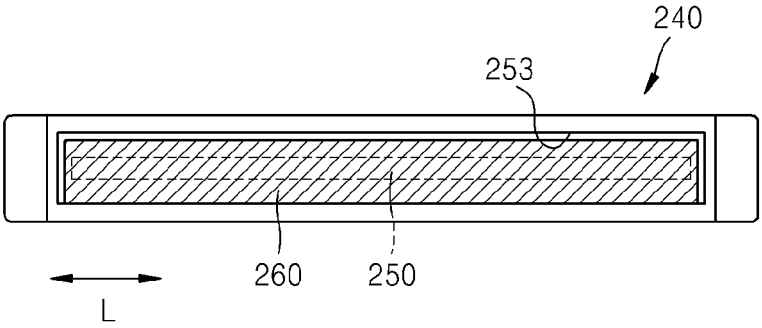
FIG. 5 is an exemplary side view of the lubricant supply unit of FIG. 4 illustrated from the right side.

FIG. 4 is an enlarged exemplary view of the lubricant supply unit 240 illustrated in, for example, in FIG. 2, and FIG. 5 is an exemplary side view of the lubricant supply unit 240, illustrated, for example, in FIG. 4 from the right side.

Referring to FIG. 4, the lubricant supply unit 240 may include a lubricant storage member 250 that stores a lubricant G1, and an impregnation member 260 that impregnates a lubricant G2 discharged from the lubricant storage member 250 and supplies the lubricant G2 to the inner surface 211 of the fixing belt 210.

The lubricant storage member 250 includes a cavity or a space in which the lubricant G1 may be stored. At least one side of the lubricant storage member 250 may be provided with an outlet 251 through which the lubricant G1 stored in the lubricant storage member 250 may be discharged.

At least one surface of the lubricant storage member 250 may be provided with an inclined plane 252. The inclined plane 252 may be provided to be inclined in a downward direction towards the outlet 251. The downward direction may be parallel to a gravity direction A. Thus, the lubricant G1 stored in the lubricant storage member 250 may be discharged through the outlet 251 along the inclined plane 252 by gravity.

Figure 6:
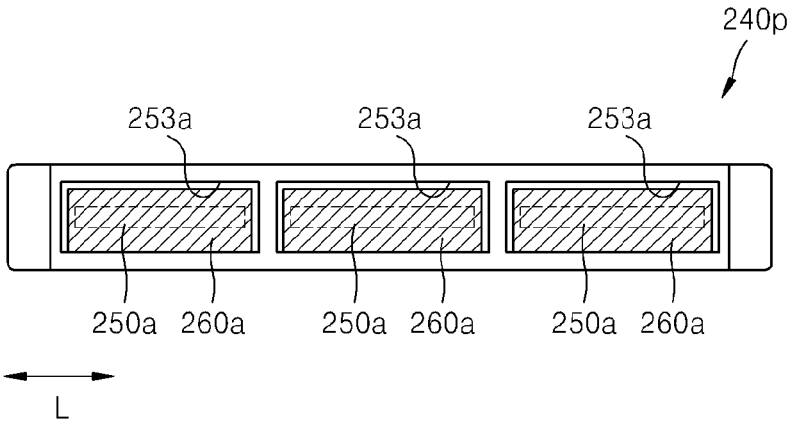
FIG. 6 illustrates an exemplary lubricant supply unit of FIG. 5.

Referring to FIG. 5, the lubricant storage member 250 may be continuously formed in a longitudinal direction L. The length of the lubricant storage member 250 may correspond to the width of the recording medium S. The longitudinal direction L may be a direction which is parallel to the width of the recording medium S and which is perpendicular to the rotation direction R of the fixing belt 210. However, the structure of the lubricant storage member 250 is not limited thereto. For example, as illustrated in FIG. 6, a lubricant storage member 250*a* of a lubricant supply unit 240*p* may be intermittently formed in the longitudinal direction L. The number of lubricant storage members 250*a* is two or more, and the lubricant storage members 250*a* may be separate from each other in the longitudinal direction L. Impregnation members 260 and 260*a* may have shapes corresponding to those of the lubricant storage members 250 and 250*a* in the longitudinal direction L, respectively, as illustrated in FIGS. 5 and 6. However, the shapes of the impregnation members 260 and 260*a* are not limited thereto. Although not illustrated in the drawing, even if the lubricant storage members 250*a* are intermittently formed in the longitudinal direction L, the impregnation members 260 and 260*a* are continuously formed in the longitudinal direction so as to be longer in length than the lubricant storage member 250*a*.

As illustrated in FIG. 4, the impregnation member 260 may be disposed at the outlet 251 of the lubricant storage member 250 so as to prevent the lubricant G1 stored in the lubricant storage member 250 from being discharged through the outlet 251 in a short time. In addition, the impregnation member 260 impregnates the lubricant G2 discharged from the outlet 251. A seating groove 253 having the impregnation member 260 being seated thereon may be formed in the vicinity of the outlet 251 of the lubricant storage member 250.

One surface of the impregnation member 260 may be disposed so as to face the outlet 251 of the lubricant storage member 250, and the other surface thereof may be disposed so as to come into contact with the inner surface 211 of the fixing belt 210. The impregnation member 260 impregnates or holds the lubricant G2 supplied through the outlet 251, and transmits the impregnated lubricant G2 to the inner surface 211 of the fixing belt 210 by coming into contact with the inner surface 211 of the fixing belt 210.

The impregnation member 260 may include felt and fabric. The felt may be formed by a tangle of fibers through compression. Examples of the fiber may include nylon or polyamide fiber, polyethylene terephthalate (PET) fiber, aramid fiber, polytetrafluoroethylene (PTFE) fiber, preoxidized polyacrylonitrile (PAN) fiber, and wool fiber. However, the definition of the felt and the material of the fiber are not limited thereto, and other felt and fiber may be used. The fabric may have a structure in which fibers are woven to have a lattice structure. Examples of the fiber may include glass fiber and aramid fiber. However, the definition of the felt and the material of the fiber are not limited thereto, and other felt and fiber may be used. The impregnation member 260 may have a structure in which a plurality of layers are laminated, as necessary. The weight per unit area of the impregnation member 260 may be 50 g/m$^2$ to 600 g/m$^2$ based on a thickness of 1 mm.

The impregnation member 260 may impregnate a portion of components of the lubricant G1 stored in the lubricant storage member 250. For example, when the lubricant G1 includes base oil and a thickener to be described later, the impregnation member 260 may impregnate the base oil but not the thickener.

In the nip forming member 220, a contact portion 221 coming into contact with the inner surface 211 of the fixing belt 210 may include at least one of a metal, felt, and fabric. Examples of the metal may include Ni, stainless steel, Cu, and an alloy thereof. The felt may be formed by a tangle of fibers through compression. Examples of the fiber may include nylon or polyamide fiber, PET fiber, aramid fiber, PTFE fiber, preoxidized PAN fiber, and wool fiber. However, the definition of the felt and the material of the fiber are not limited thereto, and other felt and fiber may be used. The fabric may have a structure in which fibers are woven to have a lattice structure. Examples of the fiber may include glass fiber and aramid fiber. However, the definition of the felt and the material of the fiber are not limited thereto, and other felt and fiber may be used.

The contact portion 221 of the nip forming member 220 may include a material that is the same as that of the impregnation member 260. Thus, the contact portion 221 of the nip forming member 220 and the impregnation member 260 may be simply manufactured. For example, when the impregnation member 260 is felt including aramid fiber as its material, the contact portion 221 of the nip forming member 220 may be felt including aramid fiber as its material. The contact portion 221 of the nip forming member 220 may have abrasion resistance that is greater than that of the impregnation member 260. Thus, even though the nip forming member 220 is subjected to higher pressure than the impregnation member 260, the lubricant G3 may be impregnated while preventing abrasion of the nip forming member 220. The contact portion 221 of the nip forming member 220 may have the same material as the impregnation member 260, but may be formed to have denser fiber tissues per unit area than the impregnation member 260. For example, the contact portion 221 of the nip forming member 220 may have a greater weight per unit area based on a thickness of 1 mm than the impregnation member 260.

[Lubricant]

The lubricant G1 stored in the lubricant storage member 250 may include base oil and a thickener (or gelling agent).

The base oil may include a heat-resisting fluorine resin so as not be deformed at a high temperature. Examples of the heat-resisting fluorine resin may include perfluoropolyether (PFPE). However, the material of the base oil is not limited thereto, and other materials may be used for the base oil. For example, the base oil may include at least one of mineral oil, ester oil, polyglycol oil, polyphenyl ether oil, silicone oil, and perfluoroalkyl ether oil. A viscosity index of the base oil may be about 50 to 800. The viscosity index is a measure indicating the degree of change in viscosity with variations in temperature. When a viscosity index of a paraffin-based standard oil (H) having a high viscosity index, for example, a viscosity index of pennsylvania-based oil is defined as 100 and a viscosity index of a naphthenic standard oil (L) having a low viscosity index, for example, a viscosity index of Gulf Coast oil may be defined as 0, the viscosity index of the base oil indicates the degree of change in viscosity with variations in temperature. The viscosity index is a well-known term, and a specific calculation method is understood by one of ordinary skill in the art.

The thickener may include a heat-resisting fluorine resin so as not to be deformed at a high temperature. Examples of the heat-resisting fluorine resin may include PTFE. However, the material of the thickener is not limited thereto. The material of the thickener may be a soap group or a non-soap group. The soap group may be classified into a metallic soap group and a complex soap group. The metallic soap group may include at least one of an aluminum (Al) soap group, a sodium (Na) soap group, a calcium (Ca) beer tallow-based soap group, a calcium castor oil-based soap group, a lithium beer tallow-based soap group, and a lithium castor oil-based soap group. The complex soap group may include at least one of a calcium complex soap group, an aluminum complex soap group, and a lithium complex soap group. The non-soap group may include at least one of silica gel, clay, and urea.

Figure 7:
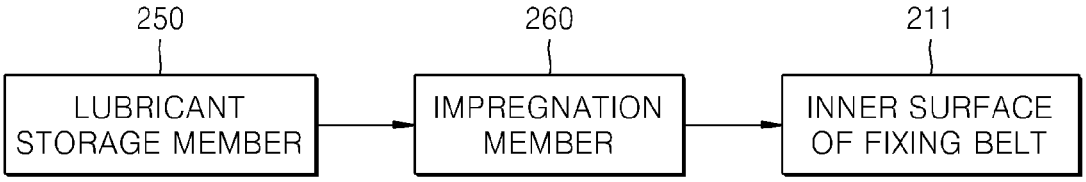
FIG. 7 is a block diagram of an exemplary moving route of a lubricant stored in a lubricant storage member of FIG. 4.

FIG. 7 is a block diagram of illustrating an exemplary moving route of the lubricant G1 stored in the lubricant storage member 250, for example, of FIG. 4. The moving route and changes in state of the lubricant G1 stored in the lubricant storage member 250 are described with reference to FIGS. 4 and 7.

The lubricant G1 stored in the lubricant storage member 250 includes base oil and a thickener. The lubricant G1 stored in the lubricant storage member 250 may be discharged to the impregnation member 260 through the outlet 251. The impregnation member 260 impregnates base oil separated from a thickener, but may not impregnate base oil, which is not separated from a thickener, in base oil. The impregnation member 260 may be felt or fabric. At least a portion of the lubricant G1 may be separated into a thickener and base oil under a high temperature environment, for example, at a temperature of 150° C. to 230° C. The base oil separated from the thickener is impregnated by the impregnation member 260. Thus, the lubricant G2 impregnated by the impregnation member 260 may have a remarkably smaller weight ratio of the thickener than that of the lubricant G1 stored in the lubricant storage member 250.

The lubricant G2 impregnated by the impregnation member 260 is transmitted to the inner surface 211 of the fixing belt 210 by a contact with the fixing belt 210. Since the lubricant G3 transmitted to the inner surface 211 of the fixing belt 210 is transmitted from the impregnation member 260, a thickener of the lubricant G3 transmitted to the inner surface 211 of the fixing belt 210 may have a remarkably smaller weight ratio than that of the lubricant G1 stored in the lubricant storage member 250.

The lubricant G3 transmitted to the inner surface 211 of the fixing belt 210 moves to the region 215 between the fixing belt 210 and the nip forming member 220 by the rotation of the fixing belt 210. The lubricant G3 having the decreased weight ratio of the thickener moves to the region 215 between the fixing belt 210 and the nip forming member 220, and thus, even if the region 215 is subjected to high pressure between the fixing belt 210 and the nip forming member 220, friction due to the thickener may be prevented. If the lubricant G3 supplied to the region 215 between the fixing belt 210 and the nip forming member 220 includes a thickener at a predetermined ratio, for example, includes a thickener of equal to or greater than 30% with respect to the total weight of the lubricant, the lubricant G3 may be separated into base oil and the thickener by high pressure and high temperature on the region 215 between the fixing belt 210 and the nip forming member 220, and only base oil in a liquid state may be discharge to the outside or evaporate. Thus, only the thickener remains in the region 215 between the fixing belt 210 and the nip forming member 220, which may increase friction. However, in an exemplary embodiment, the lubricant G3 supplied to the region 215 between the fixing belt 210 and the nip forming member 220 includes hardly any thickener, and thus even if high pressure and high temperature are applied to the region 215 between the fixing belt 210 and the nip forming member 220, a phenomenon in which only a thickener remains in the region 215 between the fixing belt 210 and the nip forming member 220 may be prevented.

The lubricant G1 stored in the lubricant storage member 250 includes a thickener at a predetermined ratio, and thus, the amount of lubricant G1 discharged from the lubricant storage member 250 may be controlled.

In a case where the impregnation member 260 is a member that impregnates only base oil of the lubricant G1, the amount of lubricant G2 impregnated by the impregnation member 260 may vary depending on the ratio of the thickener that is included in the lubricant G1 stored in the lubricant storage member 250. The impregnation member 260 may include any one of felt and fabric as its material.

In this regard, the weight of the thickener of the impregnation member 260 may be greater than 0% and equal to or less than 20% with respect to the total weight of the lubricant G1. The weight of the lubricant G1 and the thickener may be measured before the lubricant G1 is discharged to the impregnation member 260, and the total weight of the lubricant G1 may have a value obtained by adding the weight of the base oil and the weight of the thickener together.

When the weight ratio of the thickener is 0% with respect to the total weight of the lubricant G1, that is, when the lubricant G1 does not include a thickener, the lubricant G1 stored in the lubricant storage member 250 is supplied to the impregnation member 260 in a short time due to a high temperature and pressure environment. Since the supply of the lubricant G1 not including a thickener to the impregnation member 260 is not restricted by a thickener, all of the lubricant G1 may be supplied to the impregnation member 260. Thus, the lubricant G1 stored in the lubricant storage member 250 is discharged in a short time.

When the weight ratio of the thickener is greater than 0% with respect to the total weight of the lubricant G1, the supply of a portion of the lubricant G1 to the impregnation member 260 is restricted by the thickener. A portion of base oil is separated from the thickener under a predetermined temperature condition, for example, at a temperature of approximately 150° C. to 230° C., but the other portion is not separated from the thickener. Thus, only the base oil separated from the thickener is supplied to the impregnation member 260, and the base oil that is not separated from the thickener is not supplied to the impregnation member 260. The lubricant G1 stored in the lubricant storage member 250 is not supplied to the impregnation member 260 in a short time, but is gradually supplied thereto.

When the weight ratio of the thickener is greater than 20% with respect to the total weight of the lubricant G1, base oil and a thickener are hardly separated from each other. Thus, the amount of lubricant G2 supplied to the impregnation member 260 is remarkably reduced. In this case, the impregnation member 260 is not likely to perform a function of supplying the lubricant G3 to the inner surface 211 of the fixing belt 210.

A state of the lubricant G1, including the base oil and the thickener, may vary depending on a temperature condition. For example, when the lubricant G1 satisfies a predetermined temperature, the base oil and the thickener may be separated from each other. The predetermined temperature may be approximately 150° C. to 230° C., which is an inner temperature of the lubricant storage member 250 during the progress of fixing. When the lubricant G1 does not satisfy the predetermined temperature, for example, when the temperature of the lubricant G1 is less than approximately 150° C., the base oil and the thickener may not be separated from each other, and thus, the lubricant G1 may maintain a semisolid state. For this reason, it is possible to prevent the lubricant G1 of the lubricant storage member 250 from being discharged to the impregnation member 260 while fixing is not in progress.

Figure 8:
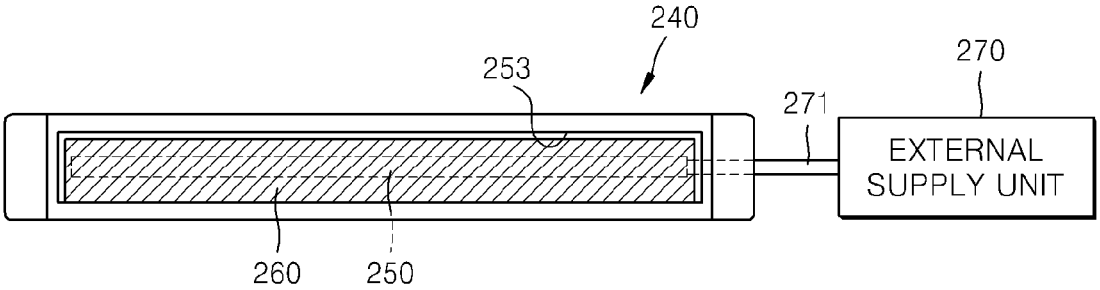
FIG. 8 is a diagram illustrating a lubricant supply unit according to an embodiment.
Figure 9:
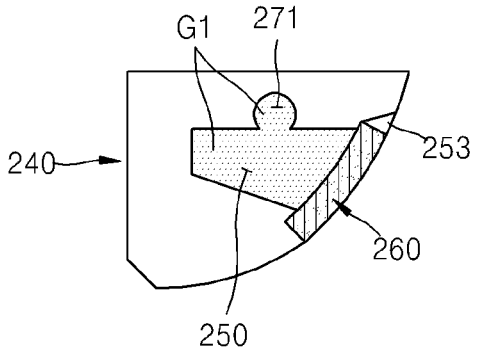
FIG. 9 is an exemplary cross-sectional view of the lubricant supply unit of FIG. 8.

FIG. 8 is a diagram illustrating an example of a lubricant supply unit 240 according to an embodiment. FIG. 9 is an exemplary cross-sectional view of the lubricant supply unit 240 of FIG. 8.

Referring to FIGS. 8 and 9, the lubricant supply unit 240 includes a lubricant storage member 250, an impregnation member 260, and an external supply unit 270. The same components as those illustrated in FIG. 4 are denoted by the same reference numerals, and a repeated description thereof will be omitted.

Unlike FIG. 5, the lubricant supply unit 240 includes the external supply unit 270 provided outside of the lubricant supply unit 240. The external supply unit 270 supplies a lubricant G1 to the lubricant storage member 250 from the outside of the fixing belt 210. A connection pipe 271 may be provided between the external supply unit 270 and the lubricant storage member 250. The lubricant G1 may be supplied from the external supply unit 270 to the lubricant storage member 250 through the connection pipe 271. The lubricant G1 of the external supply unit 270 may have the same component ratio as the lubricant G1 stored in the lubricant storage member 250. For example, the lubricant G1 of the external supply unit 270 may include base oil and a thickener, but a weight ratio of the thickener of the lubricant G1 of the external supply unit 270 is equal to or less than 20% with respect to the weight of the lubricant G1.

<Evaluation of Discharge Ratio of Lubricant from Lubricant Supply Unit>

Exemplary examination was performed on a ratio at which a lubricant is discharged from the lubricant supply unit 240 in accordance with a component ratio of the lubricant G1 stored in the lubricant storage member 250 of the lubricant supply unit 240.

Each of fixing devices 70 according to Comparative Examples 1 to 4 and Examples 1 to 4 has the pressure unit 100 and the heating unit 200 described above with reference to FIGS. 2 and 4. The heating unit 200 includes the heat source 201, the fixing belt 210, the nip forming member 220, the supporting member 230, and the lubricant supply unit 240. The lubricant supply units 240 include their respective lubricant storage members 250 having the same size and their respective impregnation members 260 using felt as materials thereof.

Comparative Examples 1 to 4 and Examples 1 to 4 differ in component ratio of a lubricant G1 used for the lubricant supply unit 240. Comparative Examples 1, 2, and 3 used a lubricant G1 that does not include a thickener, and Comparative Example 4 used a lubricant G1 having a thickener with a weight ratio which is greater than 20%. Comparative Examples 1, 2, and 3 differ in viscosity index of base oil. Examples 1 to 4 differ in weight ratio of a thickener in a range of equal to or less than 20%. In Comparative Examples 1 to 4 and Examples 1 to 4, PFPE was used as a material of the base oil. In Examples 1 to 4 and Comparative Example 4, PTFE was used as a material of the thickener. In Examples 1 to 4 and Comparative Example 4, base oil having a viscosity index of 160 was used.

Figure 10:
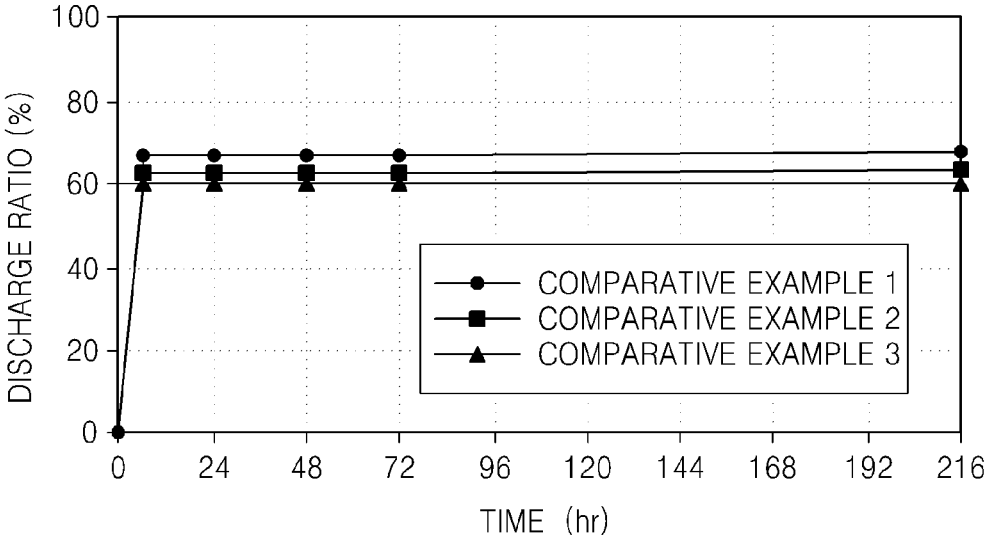
FIG. 10 is a graph illustrating a discharge ratio with the elapse of time, illustrated in Table 1, according to viscosity indexes.

Table 1 illustrates changes in weight and discharge ratios of a lubricant with the elapse of time in the lubricant supply unit 240 of the fixing device 70 according to Comparative Examples 1, 2, and 3. A high temperature condition is set to a temperature of 200° C. FIG. 10 is a graph illustrating a discharge ratio with the elapse of time, illustrated in Table 1, according to viscosity indexes of the lubricant G1.

TABLE 1

| | Base Oil Viscosity Index | | Lubricant Weight(mg) 0 hr | 6 hr | 24 hr | 48 hr | 72 hr | 216 hr |
|---|---|---|---|---|---|---|---|---|
| Comparative Example 1 | 160 | Weight | 4677.48 | 1563.24 | 1552.22 | 1542.61 | 1545.71 | 1511.45 |
| | | Discharge ratio(%) | 0.00 | 66.58 | 66.82 | 67.02 | 66.95 | 67.69 |
| Comparative Example 2 | 320 | Weight | 4598.22 | 1742.19 | 1740.40 | 1721.19 | 17.7.28 | 1658.87 |
| | | Discharge ratio(%) | 0.00 | 62.11 | 62.15 | 62.57 | 62.22 | 63.92 |
| Comparative Example 3 | 700 | Weight | 4311.05 | 1713.67 | 1701.84 | 1699.74 | 1702.82 | 1692.95 |
| | | Discharge ratio(%) | 0.00 | 60.25 | 60.52 | 60.57 | 60.50 | 60.73 |

Referring to Table 1 and FIG. 10, when the lubricant G1 not including a thickener is used as in Comparative Examples 1, 2, and 3, the lubricant G1 of approximately 60 to 70% with respect to the total lubricant G1 stored in the lubricant supply unit 240 is discharged from the lubricant supply unit 240. Most of the lubricant G1 that is not discharged from the lubricant supply unit 240 is impregnated by the impregnation member 260, and the lubricant G1 hardly remains in the lubricant storage member 250. That is, when the lubricant G1 does not include a thickener, the lubricant G1 stored in the lubricant storage member 250 is supplied to the impregnation member 260 in a short time. When the lubricant G1 supplied to the impregnation member 260 exceeds the amount of the lubricant G1 that is impregnated by the impregnation member 260, the lubricant G1 is separated from the lubricant supply unit 240.

As the viscosity index of base oil is high, the amount of separation of the lubricant G1 tends to be decreased slightly. However, the lubricant G1 is still discharged from the lubricant supply unit 240.

Figure 11:
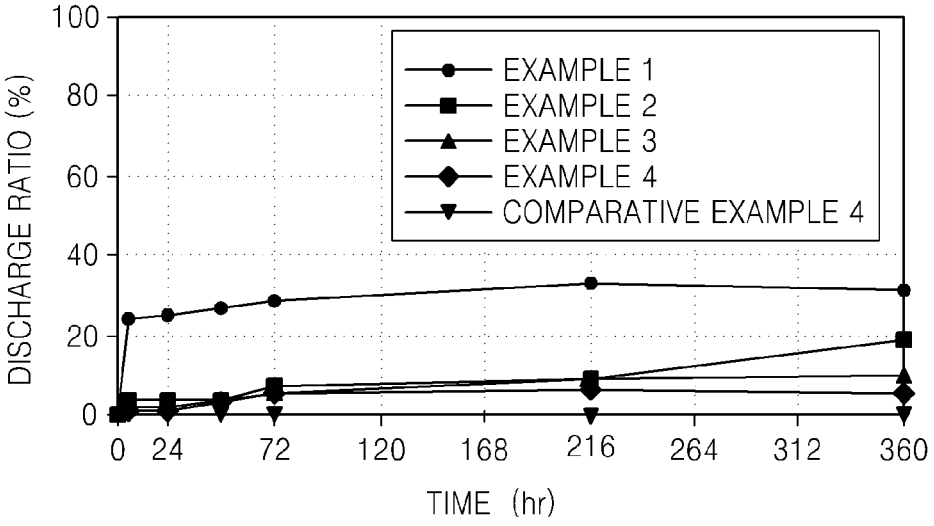
FIG. 11 is a graph illustrating an exemplary discharge ratio with the elapse of time, illustrated in Table 2, according to a weight ratio of a thickener included in a lubricant.

Table 2 illustrates changes in weight and changes in discharge ratio of a lubricant with the elapse of time in the lubricant supply unit 240 of the fixing device 70 according to Examples 1 to 4 and Comparative Example 4. A temperature condition is set to 200° C., similar to Comparative Examples 1, 2, and 3. FIG. 11 is an exemplary graph illustrating a discharge ratio with the elapse of time, illustrated in Table 2, according to a weight ratio of a thickener included in the lubricant G1.

TABLE 2

| | Thickener Ratio (%) | | Lubricant Weight(mg) 0 hr | 6 hr | 24 hr | 48 hr | 72 hr | 216 hr | 360 hr |
|---|---|---|---|---|---|---|---|---|---|
| Example 1 | 5 | Weight | 4847.08 | 3643.60 | 3610.85 | 3525.73 | 3421.86 | 3237.62 | 3320.57 |
| | | Discharge ratio(%) | 0.00 | 24.83 | 25.50 | 27.26 | 29.40 | 33.20 | 31.49 |
| Example 2 | 10 | Weight | 4792.65 | 4598.79 | 4578.35 | 4559.37 | 4435.62 | 4326.15 | 3883.63 |
| | | Discharge ratio(%) | 0.00 | 4.05 | 4.47 | 4.87 | 7.45 | 9.73 | 18.80 |
| Example 3 | 15 | Weight | 4834.56 | 4735.62 | 4685.32 | 4656.32 | 4556.36 | 4326.35 | 4295.36 |
| | | Discharge ratio(%) | 0.00 | 2.05 | 3.09 | 3.69 | 5.75 | 10.51 | 11.15 |
| Example 4 | 20 | Weight | 4814.92 | 4762.36 | 4760.32 | 4632.68 | 4532.65 | 4486.39 | 4521.36 |
| | | Discharge ratio(%) | 0.00 | 1.09 | 1.13 | 3.78 | 5.86 | 6.82 | 6.10 |
| Comparative Example 4 | 25 | Weight | 4808.98 | 4795.15 | 4765.16 | 4760.65 | 4759.65 | 4759.56 | 4759.57 |
| | | Discharge ratio(%) | 0.00 | 0.29 | 0.91 | 1.00 | 1.03 | 1.03 | 1.03 |

Referring to Table 2 and FIG. 11, the lubricant G1, including a thickener of equal to, or less than, 20%, illustrates a discharge ratio of less than approximately 35% in spite of the elapse of 360 hours. That is, as in Examples 1 to 4, when the lubricant G1 includes a thickener of equal to or less than 20%, the lubricant G1 is maintained in the lubricant storage member 250 of the lubricant supply unit 240 for a long time. As the weight of the thickener increases, the discharge ratio is further decreased.

However, when the weight of the thickener exceeds 20% as in Comparative Example 4, the discharge ratio is approximately 1% in spite of the elapse of time. The lubricant G1 is hardly impregnated by the impregnation member 260 because of the lubricant G1 being hardly separated into base oil and a thickener.

In other words, the lubricant supply unit 240 according to an exemplary embodiment is set such that the weight ratio of the thickener of the lubricant G1 stored in the lubricant storage member 250 is equal to, or less than, 20% with respect to the total weight of the lubricant G1, and thus, it is possible to prevent the lubricant G1 stored in the lubricant supply unit 240 from being separated from the lubricant supply unit 240 and to stably supply the lubricant G3 to the inner surface 211 of the fixing belt 210.

<Evaluation of Lifespan of Fixing Device>

Exemplary examination was performed on the amount of torque applied to the pressure unit 100 in a case where the lubricant G1 is directly supplied to the region 215 between the fixing belt 210 and the nip forming member 220 without a lubricant supply unit (Comparative Examples 5-1 to 5-3) and in a case where the lubricant G1 including a thickener is stored in the lubricant storage member 250 and is supplied to the fixing belt 210 and the nip forming member 220 through the impregnation member 260 (Examples 5-1 to 5-3).

Examples 5-1 to 5-3 include the pressure unit 100 and the heating unit 200 that are described above with reference to FIGS. 2 and 4. The fixing devices 70 according to Comparative Examples 5-1 to 5-3 have the same configurations as those of Examples 5-1 to 5-3 except that a lubricant supply unit is not present. The thickener included in each of the lubricants G1 according to Examples 5-1 to 5-3 includes PTFE as its material, and the weight of the thickener is 10% with respect to the total weight of the lubricant G1. The thickener included in each of the lubricants G1 according to Comparative Examples 5-1 to 5-3 includes PTFE as its material, and the weight of the thickener is 45% with respect to the total weight of the lubricant G1. Comparative Examples 5-1 to 5-3 have the same conditions, and Examples 5-1 to 5-3 have the same conditions. An experiment was repeatedly performed three times with respect to Example and Comparative Example which have the same conditions, and a result of the experiment was obtained.

Heat was repeatedly applied to the fixing devices 70 according to Comparative Examples 5-1 to 5-3 and the fixing devices 70 according to Examples 5-1 to 5-3 to drive the pressure unit 100. A value of torque applied to the pressure unit 100 depending on the recording medium S fixed by the fixing device 70 was examined.

Figure 12:
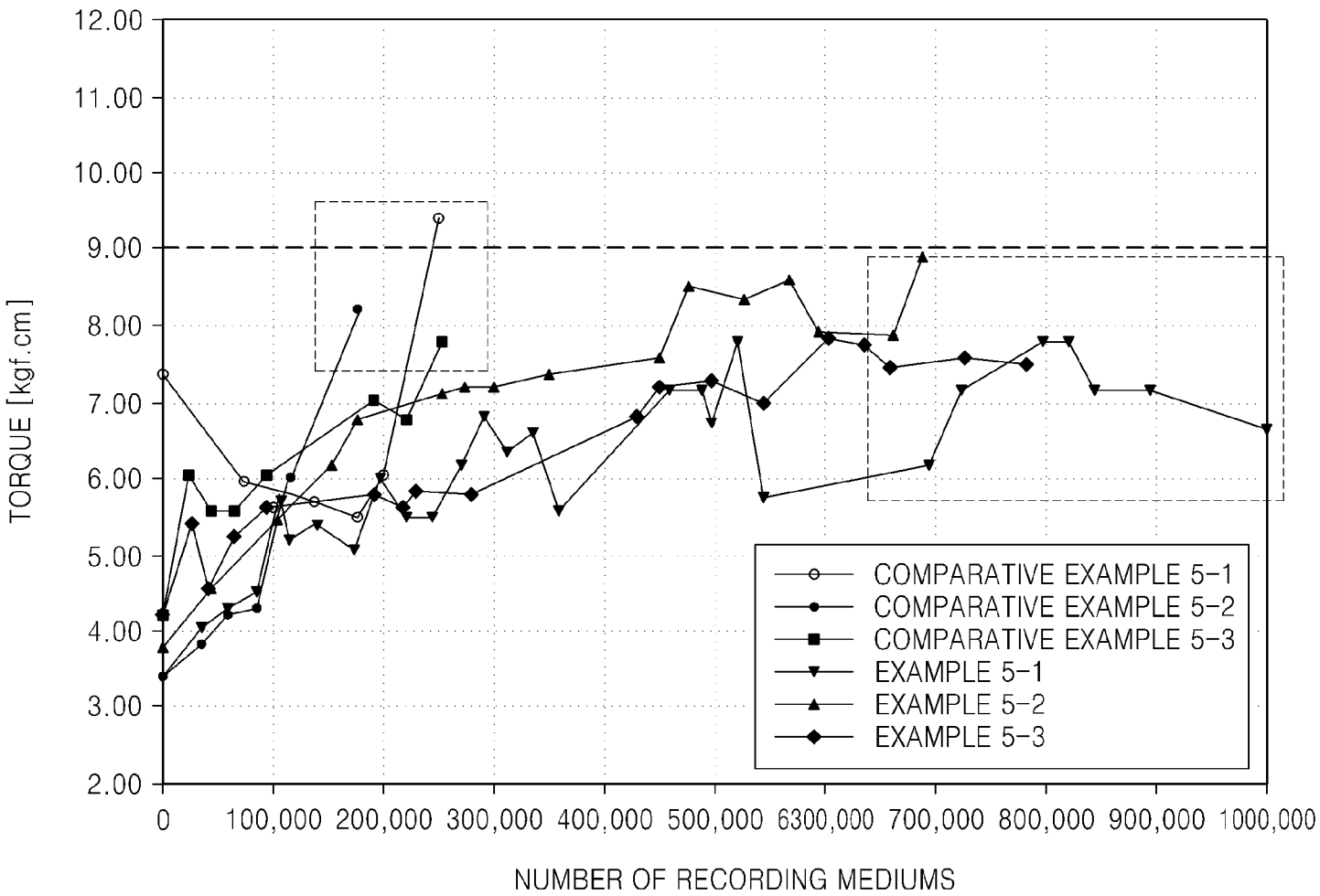
FIG. 12 is a graph illustrating exemplary lifespan of fixing devices according to Comparative Examples 5-1 to 5-3 and Examples 5-1 to 5-3.

FIG. 12 is a graph illustrating the lifespan of fixing devices according to Comparative Examples 5-1 to 5-3 and Examples 5-1 to 5-3. Referring to FIG. 12, in Comparative Example 5-1, torque applied to the pressure unit 100 exceeded a predetermined torque limit value, for example, 9 kgf·cm before the number of fixed recording mediums S reaches 300,000. In Comparative Examples 5-2 and 5-3, although torque applied to the pressure unit 100 did not exceed 9 kgf·cm, the fixing belt 210 was damaged before the number of fixed recording mediums S reaches 300,000. On the other hand, in Examples 5-1, 5-2, and 5-3, even though the number of fixed recording mediums S exceeded approximately 600,000, a value of torque did not exceed 9 kgf·cm which is a torque limit value, and the fixing belt 210 was not damaged. In Example 5-1, the fixing belt 210 was not damaged and a value of torque did not exceed a predetermined torque value until the number of fixed recording mediums S reached 1,000,000.

In other words, when a fixing device includes the lubricant supply unit 240 that stores the lubricant G1 including a thickener having a weight of equal to or less than 20% as in the present invention, the lifespan of the fixing device is extended by at least twice, as compared with a fixing device that does not include a lubricant supply unit.

According to the fixing device and the image forming apparatus, a lubricant is continuously supplied between a nip forming member and a fixing belt, and the lubricant stored in a lubricant supply unit is prevented from being discharged to the outside in a short time, thereby preventing the fixing belt from snaking or being damaged.

According to an exemplary embodiment, a rotation unit is the pressure unit 100 and the fixing belt 210 rotating by following the rotation unit is included in the heating unit 200. However, these embodiments are merely illustrative. The rotation unit may be the heating unit 200, and the fixing belt 210 rotating by following the rotation unit may be included in the pressure unit 100, for example. The nip forming member 220 and the lubricant supply unit 240 may be included in the pressure unit 100.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A fixing device comprising:

a rotation unit that is rotatable;

a fixing belt configured to contact an outer surface of the rotation unit and to be rotated by rotating of the rotation unit;

a nip forming member configured to contact an inner surface of the fixing belt and to form a fixing nip in a contact portion between the rotation unit and the fixing belt; and a lubricant supply unit configured to supply a lubricant between the fixing belt and the nip forming member, the lubricant supply unit including:

a lubricant storage member configured to store a first lubricant including a base oil and a thickener, and an impregnation member configured to impregnate a second lubricant discharged from the lubricant storage member having the base oil separated from the thickener and supplying the second lubricant to the inner surface of the fixing belt, wherein the first lubricant stored in the lubricant storage member comprises a base oil and a thickener, and a weight of the thickener is equal to or less than 20% with respect to a weight of the lubricant.

2. The fixing device of claim 1, wherein the base oil comprises a heat-resisting fluorine resin.

3. The fixing device of claim 2, wherein the heat-resisting fluorine resin comprises perfluoropolyether (PFPE).

4. The fixing device of claim 2, wherein a viscosity index of the base oil is approximately 50 to 800.

5. The fixing device of claim 1, wherein the thickener comprises a heat-resisting fluorine resin.

6. The fixing device of claim 5, wherein the heat-resisting fluorine resin comprises polytetrafluoroethylene (PTFE).

7. The fixing device of claim 1, wherein the lubricant supply unit is disposed on an upstream side or a downstream side of the nip forming member in a rotation direction of the fixing belt.

8. The fixing device of claim 1, wherein the impregnation member comprises at least one of felt and fabric.

9. The fixing device of claim 8, wherein the impregnation member has a weight per unit area of 50 to 600 g/m$^2$ based on a thickness of 1 mm.

10. The fixing device of claim 1, wherein a contact portion with the inner surface of the fixing belt in the nip forming member comprises at least one of felt and fabric.

11. The fixing device of claim 10, wherein the contact portion of the nip forming member has a greater abrasion resistance than the impregnation member.

12. The fixing device of claim 1, wherein the lubricant storage member is continuously formed in a longitudinal direction of the fixing belt.

13. The fixing device of claim 1, further comprising an external supply unit that is disposed outside of the fixing belt and supplies a lubricant to the lubricant storage member.

14. The fixing device of claim 1, further comprising a heat source that heats the fixing belt.

15. The fixing device of claim 1, wherein the rotation unit is a pressure roller that presses a recording medium passing through the fixing nip.

16. A fixing device comprising:

a rotation unit configured to be rotatable;

a fixing belt configured to contact an outer surface of the rotation unit and is rotated by rotating of the rotation unit;

a nip forming member configured to contact an inner surface of the fixing belt and forms a fixing nip in a contact portion between the rotation unit and the fixing belt; and a lubricant supply unit configured to supply a lubricant between the fixing belt and the nip forming member and comprises a lubricant storage member configured to store the lubricant and an impregnation member impregnating the lubricant discharged from the lubricant storage member and supplying the lubricant to the inner surface of the fixing belt, wherein the lubricant stored in the lubricant storage member comprises a base oil and a thickener, and a weight of the thickener is equal to or less than 20% with respect to a weight of the lubricant, and wherein the lubricant storage member is intermittently formed in a longitudinal direction of the fixing belt.

17. An image forming apparatus comprising:

a photoconductor in which a latent image is formed;

a developing unit configured to supply a toner to the latent image and to form a visible toner image in a recording medium; and a fixing device configured to apply a heat and a pressure to the toner image transferred to the recording medium and fixes the toner image, comprising:

a fixing belt configured to contact an outer surface of the rotation unit and to be is rotated by rotating of the rotation unit;

a nip forming member configured to contact contacts an inner surface of the fixing belt and to form a fixing nip in a contact portion between the rotation unit and the fixing belt; and a lubricant supply unit configured to supply a lubricant between the fixing belt and the nip forming member, the lubricant supply unit including:

a lubricant storage member storing the configured to store a first lubricant including a base oil and a thickener, and an impregnation member configured to impregnate a second lubricant discharged from the lubricant storage member having the base oil separated from the thickener and supplying the second lubricant to the inner surface of the fixing belt, wherein the first lubricant stored in the lubricant storage member comprises a base oil and a thickener, and a weight of the thickener is equal to or less than 20% with respect to a weight of the lubricant.

18. The image forming apparatus of claim 17, wherein the base oil comprises perfluoropolyether (PFPE).

19. The image forming apparatus of claim 17, wherein the thickener comprises polytetrafluoroethylene (PTFE).

20. The image forming apparatus of claim 17, wherein the impregnation member comprises at least one of felt and fabric.

21. A fixing device including a rotation unit and a fixing belt, the fixing device comprising:

a nip forming member configured to contact a surface of the fixing belt and forms a fixing nip in a contact portion between the rotation unit and the fixing belt;

a plurality of lubricant storage members configured to store a lubricant;

a lubricant supply unit configured to supply at least some of the stored lubricant to a surface of the fixing belt, wherein the lubricant stored in at least one of the plurality of lubricant storage members comprises a base oil and a thickener, and a weight of the thickener is equal, to or less than 20%, with respect to a weight of the lubricant, and wherein the at least some of the stored lubricant supplied to the surface of the fixing belt having the base oil separated from the thickener.

* * * * *